US007645172B2

(12) United States Patent
Imai

(10) Patent No.: US 7,645,172 B2
(45) Date of Patent: Jan. 12, 2010

(54) CONNECTOR AND ASSEMBLING METHOD THEREFOR

(75) Inventor: Yuujirou Imai, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/018,253

(22) Filed: Jan. 23, 2008

(65) Prior Publication Data

US 2008/0176454 A1 Jul. 24, 2008

(30) Foreign Application Priority Data

Jan. 24, 2007 (JP) ..... 2007-013411

(51) Int. Cl.
*H01R 13/40* (2006.01)

(52) U.S. Cl. ..... 439/733.1; 439/884

(58) Field of Classification Search ..... 439/79, 439/246, 733.1, 752.5, 869, 884
See application file for complete search history.

(56) References Cited

U.S. PATENT DOCUMENTS

| | | | | |
|---|---|---|---|---|
| 6,086,434 | A | 7/2000 | Rollero et al. | |
| 6,155,885 | A | 12/2000 | Kumakura | |
| 6,328,576 | B1 | 12/2001 | Takahashi | |
| 6,953,372 | B2 * | 10/2005 | Takada | 439/733.1 |
| 7,004,766 | B2 * | 2/2006 | Chen et al. | 439/79 |
| 7,033,229 | B2 * | 4/2006 | Tsuchiya | 439/733.1 |
| 7,134,886 | B2 | 11/2006 | Okamura et al. | |
| 7,175,480 | B2 * | 2/2007 | Yamashita | 439/733.1 |
| 7,357,680 | B2 * | 4/2008 | Nakamura et al. | 439/866 |
| 2001/0049213 | A1 | 12/2001 | Potters et al. | |

FOREIGN PATENT DOCUMENTS

| | | |
|---|---|---|
| EP | 0079665 | 5/1983 |
| JP | 63-117069 | 7/1988 |
| JP | 1-66767 | 4/1989 |
| JP | 7-25583 | 5/1995 |
| JP | 2002-015806 | 1/2002 |

* cited by examiner

*Primary Examiner*—Thanh-Tam T Le
(74) *Attorney, Agent, or Firm*—Gerald E. Hespos; Anthony J. Casella

(57) ABSTRACT

A connector has terminal fittings (20) with a touching section (41) to be held in contact with a mating terminal (30) and a housing (10) formed with press-in holes (14, 14A), into which the terminal fittings (20) are pressed. The terminal fittings (20) are pressingly held in the housing (10) after the touching sections (41) pass through the press-in holes (14, 14A). A part of the inner surface of each press-in hole (14, 14A) of the housing (10) corresponding to a passage area of the touching section (41) is shaped to be gradually distanced from the passage area towards an apex (62, 62A) at a width-wise middle part (65) of the passage area. Accordingly, mutual abrasion of the touching section (41) and the inner surface of the press-in hole (14, 14A) can be avoided when the touching section (41) passes through the press-in hole (14, 14A).

16 Claims, 7 Drawing Sheets

CONNECTOR AND ASSEMBLING METHOD THEREFOR

BACKGROUND OF THE INVENTION

1. Field of the Invention

The invention relates to a connector and to an assembling method therefor.

2. Description of the Related Art

U.S. Pat. No. 7,134,886 discloses a connector to be mounted on a printed circuit board. This connector has a housing formed with press-in holes and terminal fittings that are mounted in the press-in holes. Each terminal fitting has a touching section to be held in contact with a mating female terminal. A front part of each terminal fitting, including the touching section, has a rectangular cross-section, and the press-in hole has a similarly dimensioned rectangular cross-section. The terminal fitting is inserted into the press-in hole of the housing from behind, and a rear part of the terminal fitting behind the touching section is held pressingly in the press-in hole after the touching section passes through the press-in hole.

The front part of the terminal fitting, including the touching section, has substantially the same cross-sectional size and shape as the press-in hole. Thus, there is a likelihood that the inner surface of the press-in hole will abrade against a plated surface of the touching section each and will damage the plated surface as the touching section passes through the press-in hole. The cross-sectional sizes could be selected to define a clearance between the touching section and the inner surface of the press-in hole. However, the touching section still could contact the inner surface of the press-in hole in view of tolerances, displacements, and such.

The invention was developed in view of the above situation and an object thereof is to prevent a touching section of a terminal fitting from being damaged.

SUMMARY OF THE INVENTION

The invention relates to a connector with a housing formed with at least one press-in hole and at least one terminal fitting that can be pressed into the press-in hole. The terminal fitting has a touching section to be held in contact with a mating terminal, and a passage area is defined at a widthwise intermediate part of the touching section. A part of the inner surface of the press-in hole corresponding to the passage area of the touching section is shaped to be distanced from the passage area towards an apex corresponding to a widthwise intermediate part of the passage area. Thus, mutual abrasion of the touching section and the inner surface of the press-in hole is avoided when the touching section passes through the press-in hole. As a result, the touching section cannot be damaged.

The terminal fitting preferably is held pressingly in the housing after the touching section passes through the press-in hole.

Ridge surfaces preferably are defined at the opposite widthwise ends of the passage area of the touching section. The ridge surfaces preferably are aligned substantially obliquely and extend straight toward the apex. The ridge surfaces function to align the touching section if the touching section tries to be displaced towards the apex upon passing through the press-in hole.

Sides of the press-in hole and the ridge surfaces preferably are substantially straight lines and the apices are points. The sides of the press-in hole preferably are longer than the ridge surfaces. An angle between the ridge surfaces at the opposite sides of each apex preferably is larger than about 120°, and angles between the sides and the ridge surfaces preferably are smaller than about 120°.

Bevels preferably are formed at least at one of the opposite widthwise end corners of the touching section in the terminal fitting. A bevel angle of the bevels preferably is smaller than an angle of inclination of stand-up parts of ridge surfaces of the inner surface of the press-in hole of the housing corresponding to the opposite widthwise ends of the passage area of the touching section with respect to a reference line parallel to the touching section. Thus, a clearance invariably is defined between the bevels and the ridge surfaces unless the touching section is inclined a large amount about an axis when the touching section passes through the press-in hole. As a result, the bevels and the ridge surfaces constantly are kept away from each other, and damage to the touching section can be prevented reliably.

A through hole preferably penetrates the housing in a press-in direction of the terminal fitting, and the press-in hole is formed only in a part of the through hole in the press-in direction.

The terminal fitting preferably has a wider section behind the touching section in the press-in direction. The wider section is wider than the touching section and is pressed and fixed by the inner surface of the press-in hole. Thus, opposite widthwise ends of the touching section cannot abrade against the inner surface of the press-in hole when the touching section passes through the press-in hole.

These and other features of the invention will become more apparent upon reading the following detailed description of preferred embodiments and accompanying drawings. Even though embodiments are described separately, single features thereof may be combined to additional embodiments.

DETAILED DESCRIPTION OF THE PREFERRED EMBODIMENTS

A circuit board connector in accordance with a first embodiment of the invention is described with reference to FIGS. 1 to 4. The circuit board connector is to be mounted on an electric or electronic device, such as a printed circuit board (not shown), is provided with a housing 10 that connectable with a mating connector (not shown) and terminal fittings 20 to be mounted in the housing 10. In the following description, an end to be connected with the mating connector is referred to as the front concerning forward and backward directions FBD.

Figure 1:
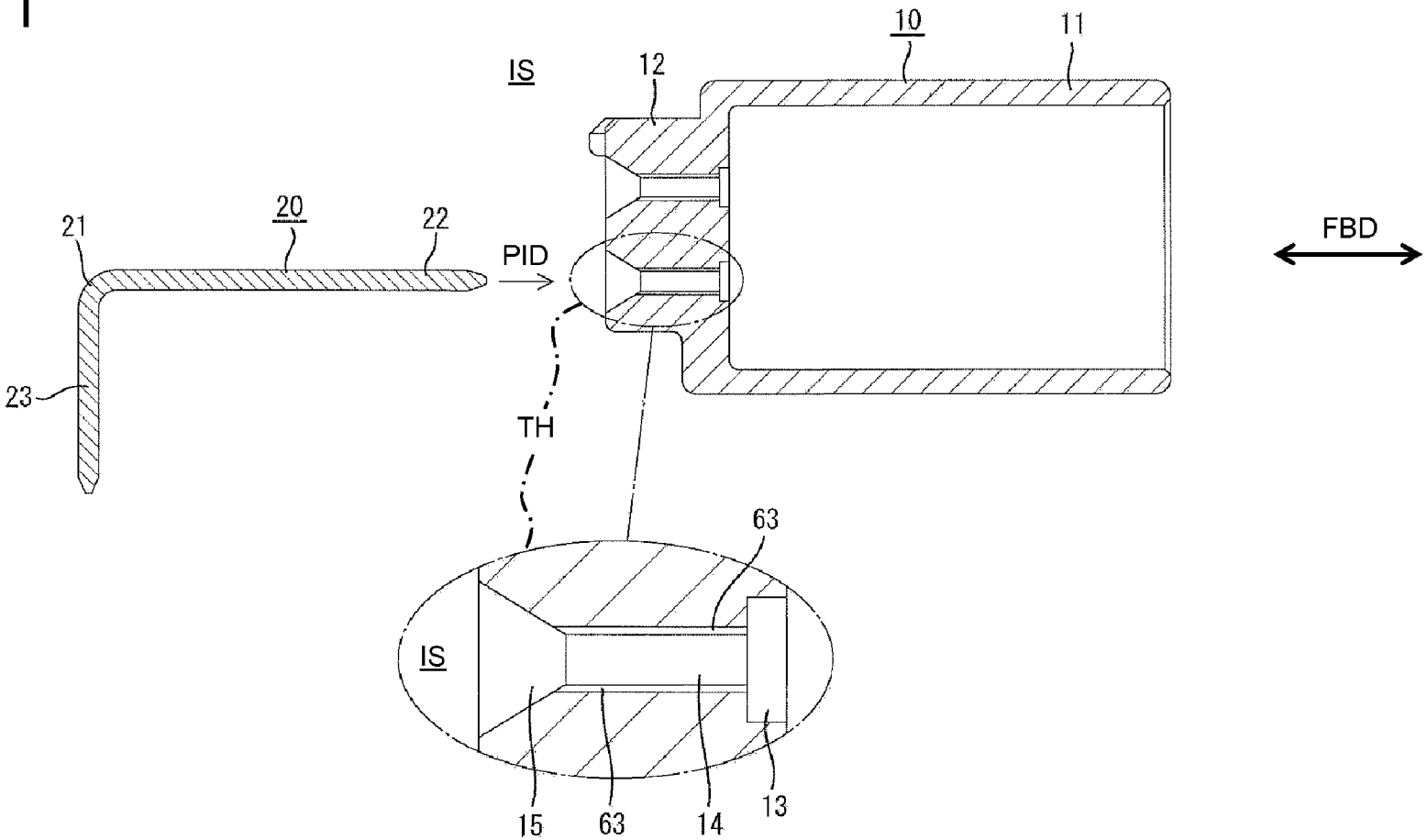
FIG. 1 is a side view in section showing a state before terminal fittings are mounted into a housing in a connector of a first embodiment.

The housing 10 is made e.g. of synthetic resin and includes a substantially tubular receptacle 11, as shown in FIG. 1.

Through holes TH penetrate a back wall 12 of the receptacle 11 in forward and backward directions and the terminal fittings 20 are inserted through the through holes TH from behind and at an insertion side IS. Each through hole TH includes a recessed hole 13, a press-in hole 14 and a guiding hole 15. The recessed holes 13 communicate with the front ends of the press-in holes 14 and the guiding holes 15 communicate with the rear ends of the press-in holes 14. The recessed holes 13 have a diameter larger than the press-in holes 14 and open in the front surface of the back wall 12. The guiding holes 15 converge in a substantially conical shape and widen from the rear ends of the press-in holes 14 towards the rear surface of the back wall 12.

The press-in holes 14 extend over a specified range in substantially forward and backward directions FBD and have substantially the same cross-sectional shape along the entire length in forward and backward directions FBD. The terminal fitting 20 is inserted through the guiding hole 15 and is pressed into the press-in hole 14 in a press-in direction PID for support in the housing 10. The shape of the press-in hole 14 is described in detail later.

Each terminal fitting 20 is a busbar in the form of a long narrow substantially rectangular column or portion and is bent approximately 90° at an intermediate position to define a substantially in L-shape. Thus, the terminal fitting 20 includes a bend 21, a horizontal portion 22 arranged substantially along the forward and backward directions FBD before the bend 21 and a vertical portion 23 extending substantially perpendicularly down from the bend 21 towards the electric or electronic device such as the printed circuit board. The leading end of the vertical portion 23 is to be connected with a conduction path of the electric or electronic device by soldering, welding, ultrasonic welding, press-fitting or the like.

Figure 2:
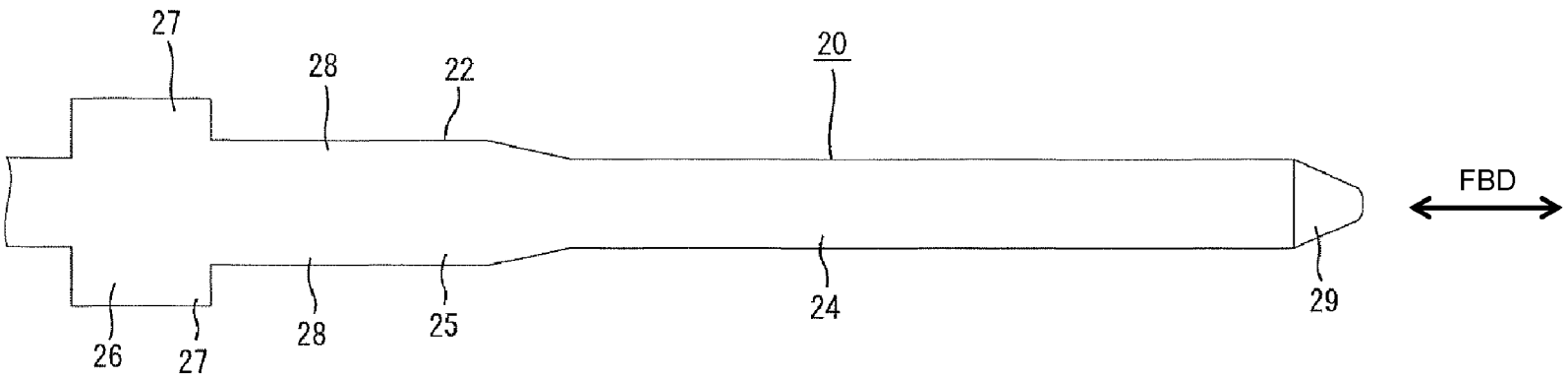
FIG. 2 is an enlarged plan view showing a horizontal portion of the terminal fitting.

The horizontal portion 22 is a tab having a substantially rectangular cross section and includes a narrow section 24, a wide section 25 and a bulging section 26 in this order from the front along the forward and backward directions FBD, as shown in FIG. 2. Thus, the horizontal portion 22 is widened stepwise towards the bulging portion 26. Two preventing pieces 27 project laterally at the opposite widthwise sides of the bulging section 26, and can contact the rear surface of the back wall 12 to prevent the terminal fitting 20 from coming out forward.

The wide section 25 is pressed and fixed by the inner surfaces of the press-in hole 14 upon properly mounting the terminal fitting 20 in the press-in direction PID into the housing 10. The opposite widthwise sides of the wide section 25 substantially coincide in position with the opposite widthwise sides of the inner surface of the press-in hole 14 and define press-in portions 28 to be pressed and fixed by the opposite widthwise sides of the inner surfaces of the press-in hole 14.

The narrow section 24 has a substantially square cross-section, and is located in the receptacle 11 after passing through the through hole TH of the back wall 12 without touching the inner periphery of the through hole TH. The leading end of the narrow section 24 is cut over substantially the entire periphery to form a tapered surface 29 for guiding the terminal fitting 20 into the through hole TH. The narrow sections 24 connect with mating terminals 30 accommodated in the mating connector as the connector is connected with the mating connector.

Figure 4:
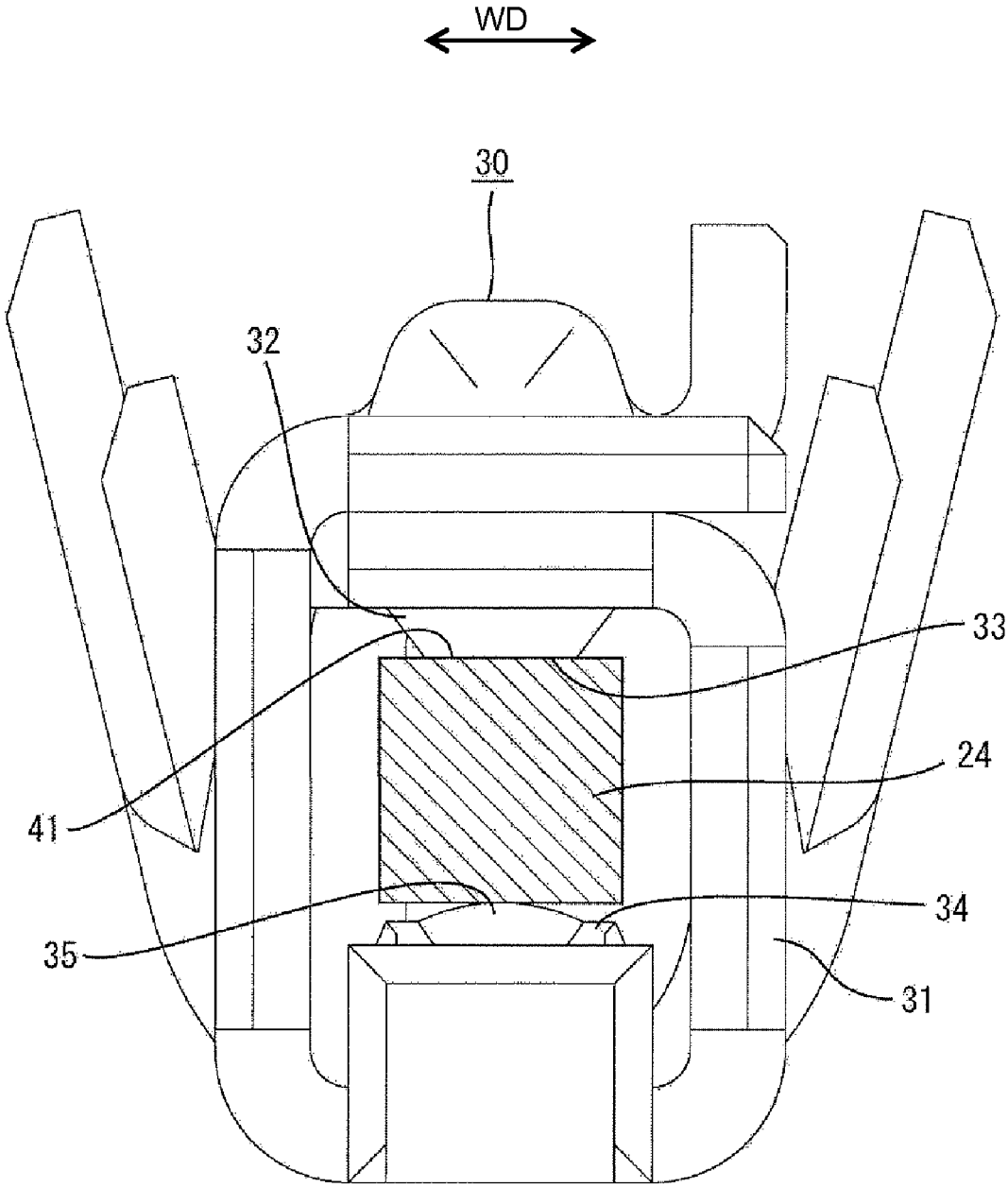
FIG. 4 is an enlarged vertical section showing a state where the touching section is in contact with a mating terminal.

The mating terminal 30 is a female terminal fitting and with a substantially rectangular tubular box 31 that can receive the narrow section 24, as shown in FIG. 4. A receiving portion 32 projects in from the inner surface of the box 31, and a contact surface 33 is defined the projecting end of the receiving portion 32. The contact surface 33 is substantially flat and continuous in the width direction WD at the substantially same height. A resiliently deformable contact piece 34 faces the receiving portion 32 in the box 31 and a contact 35 is embossed on the contact piece to project convexly towards the contact surface 33.

Upon entering the box 31, the narrow section 24 is held resiliently sandwiched between the receiving portion 32 and the resilient contact piece 34 in the height direction. In this state, the upper and lower surfaces of the narrow section 24 substantially facing each other in the height direction are in contact with the mating terminal 30. Specifically, a substantially widthwise intermediate part of the upper surface of the narrow section 24 is in surface contact with the contact surface 33 of the receiving portion 32 to define a touching section 41, and a substantially widthwise intermediate part of the lower surface of the narrow section 24 is in point contact with the contact 35 of the resilient contact piece 34. The widthwise intermediate parts may be shifted slightly from the widthwise middle, e.g. by less than about ⅓ of the total width, more preferably by less than about ¼ of the total width. The touching section 41 is a horizontally continuous surface at the same height, and hence contains the forward and backward directions FBD. Plating, such as tin or gold plating, preferably is applied thereto to increase contact reliability with the mating terminal 30.

Figure 3:
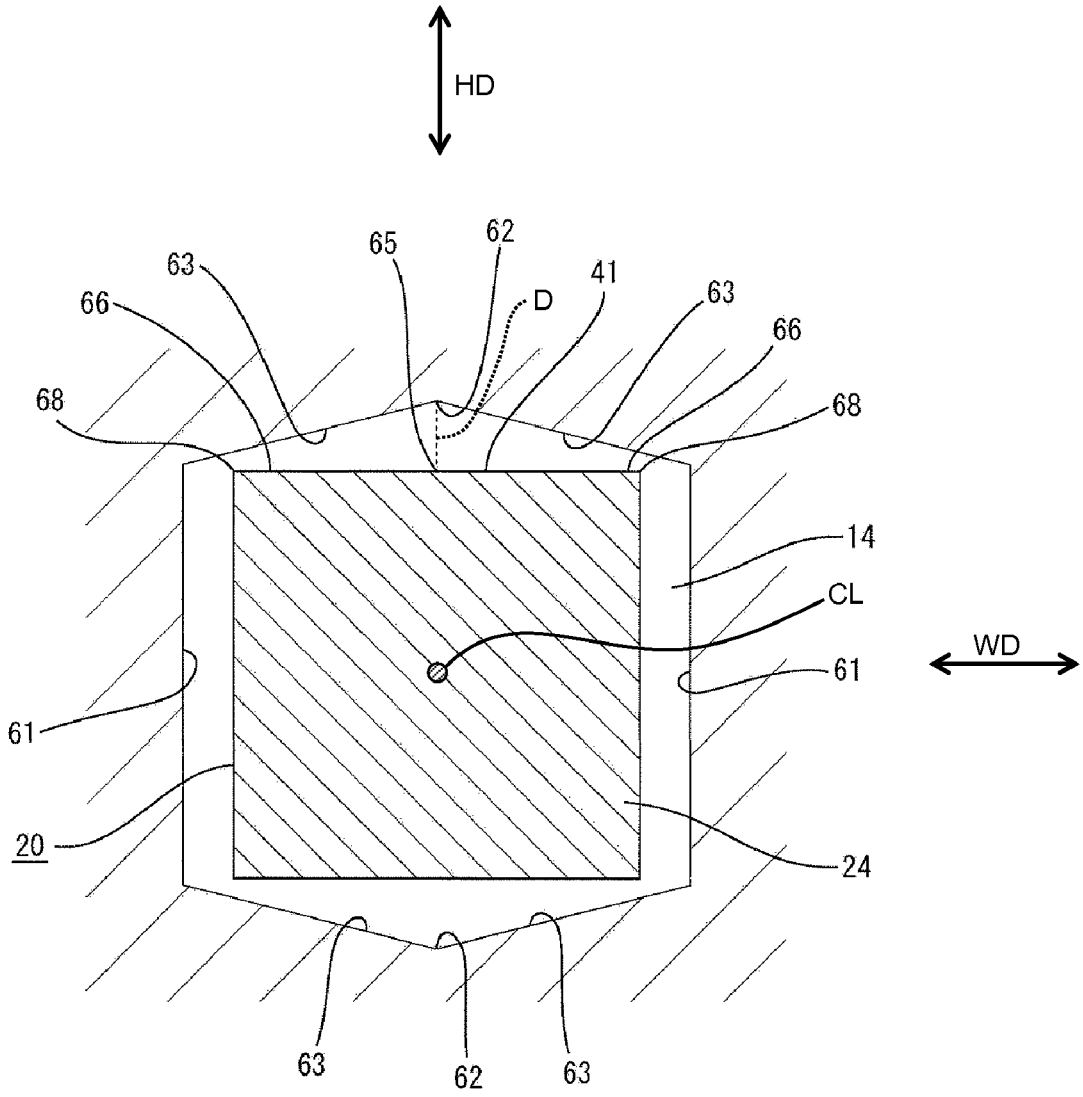
FIG. 3 is an enlarged vertical section showing a state where a touching section is inserted in a press-in hole.

The press-in hole 14 is a substantially hexagonal opening as shown in FIG. 3 and is defined by left and right substantially parallel side surfaces 61 facing each other in the width direction WD and upper and lower pairs of ridge surfaces 63 extending obliquely with respect to the widthwise direction WD towards upper and lower apices 62 in the widthwise center of the press-in hole 14 while intersecting with the upper and lower ends of the side surfaces 61 at obtuse angles of about 100° to about 160°, more preferably about 100° to about 130°, most preferably about 100° to about 120°. The apex 62 and the narrower section 24 of the terminal fitting 14 are spaced apart by a distance D (when measured radially with respect to an imaginary longitudinal center line CL of the terminal fitting 14) that is larger than a distance at any other position of the respective ridge surface 63 of the press-in hole 14. Thus, the clearance between the inner surface of the press-in portion 14 and the terminal fitting 20 is enlarged when seen in a peripheral direction at a position corresponding to the apex 62. The side surfaces 61 and the ridge surfaces 63 are substantially planar and the apices 62 are straight lines extending in the forward and backward direction FBD. Height dimensions of the side surfaces 61 exceed the transverse dimensions of the ridge surfaces 63, and an angle between the both ridge surfaces 63 at the opposite sides of each apex 62 is larger than about 120°, and angles between the side surfaces 61 and the ridge surfaces 63 are smaller than about 120°.

A clearance is defined between the narrow section 24 and the inner surface of the press-in hole 14 over substantially the entire periphery when the narrow section 24 passes through the press-in hole 14 at a proper position, as shown in FIG. 3. The apex 61 and the ridge surfaces 63 are at positions on the inner surface of the press-in hole 14 corresponding in the height direction HD to a passage area of the touching section 41, as shown in FIG. 3, and the apex 62 aligns with the widthwise middle part 65 of the passage area of the touching section 41. The ridge surfaces 63 align with positions corresponding to the opposite widthwise sides 66 of the passage area of the touching section 41, and are distanced gradually farther from the touching section 41 to intersect at the apex 62 while extending from the corresponding sides 61 towards the apex 62. Thus, the apex 62 is farthest from the touching section 41, the ridge surfaces 63 are spaced farther from the touching section 41 as they extend from the corresponding side surfaces 62 towards the apex 62, and a substantially triangular clearance is defined between the touching section 41 and the inner surface of the press-in hole 14.

The narrow section 24 could be inserted into the press-in hole 14 while being offset in the height direction HD. However, the touching section 41 cannot touch the inner surface of the press-in hole 14 even though the opposite widthwise corners 68 of the touching section 41 may possibly touch the ridge surfaces 63 or the intersections of the ridge surfaces 63 and the sides 61. A part where the lower surface of the narrow section 24 opposite to the touching section 41 passes is shaped identically to the above-described part of the inner surface corresponding to the passage area of the touching section 41 and has the same functions and effects to be described later.

The terminal fitting 20 is inserted into the through hole TH of the housing 10 from the insertion side IS. More particularly, the narrow section 24 passes through the through hole TH and then the wider section 25 is pressed into the press-in hole 14. As a result, the widthwise ends of the press-in portions 28 are pressed and held over the entire length in height direction HD by the inner surfaces of the press-in hole 14. The terminal fitting 20 then is bent substantially perpendicularly into an L-shape with the horizontal portion 22 and the vertical portion 23. Of course, this bending operation may be performed before the terminal fitting 20 is mounted into the housing 10.

The part of the inner surface of the press-in hole 14 corresponding to the passage area of the touching section 41 is defined by the ridge surfaces 63, which are spaced gradually greater distances from the passage area towards apex 62 in areas corresponding to the widthwise middle part 65 of the passage area. Thus, even in consideration of tolerances, displacements, etc., there is no likelihood that the touching section 41 and the inner surface of the press-in hole 14 will abrade against each other when the touching section 41 passes through the press-in hole 14. As a result, the touching section 41 is protected to prevent the plating of the touching section 41 from being peeled off or damaged.

The ridge surfaces 63 of the press-in hole 14 of the housing 10 extent obliquely and substantially straight towards the apex 62. Thus, the opposite widthwise corners 68 of the touching section 41 contact the respective ridge surfaces 63 if the touching section 41 tries to displace towards the apex 62 upon passing through the press-in hole 14. As a result, the touching section 41 is corrected to a substantially proper position of passage by the ridge surfaces 63. Further, the ridge surfaces 63 are substantially planar. Hence, the touching section 41 and the ridge surfaces 63 do not interfere with each other even if the narrower section 24 is inclined slightly.

The touching section 41 is narrower than the wider section 25. Thus, the opposite widthwise ends of the touching section 41 cannot abrade against the inner surface of the press-in hole 14 to be damaged when the touching section 41 passes through the press-in hole 14. The apices 62 in the inner surface of the press-in hole 14 prevent contact of the touching section 41 with the inner surface of the press-in hole 14 (ridge surfaces 63) unless the narrow section 24 is inclined a large amount about an axis provided the dimensions of the cross-sectional shape of the narrow section 24 are equal to or smaller than the diameter of the press-in hole 14.

A second embodiment of the invention is described with reference to FIGS. 5 to 7. In the second embodiment, the shape of narrow sections 24A of terminal fittings 20 and that of press-in holes 14A are different from those of the first embodiment. The other construction is similar to the first embodiment. Similar elements are not described again, but are identified by the same reference numerals.

Figure 5:
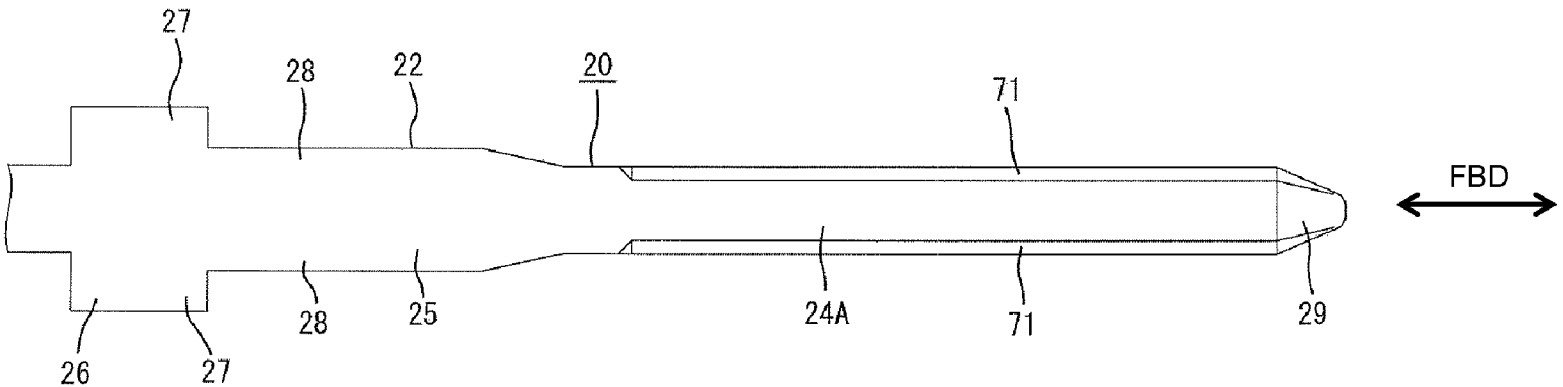
FIG. 5 is an enlarged plan view of a horizontal portion of a terminal fitting in a connector of a second embodiment.
Figure 6:
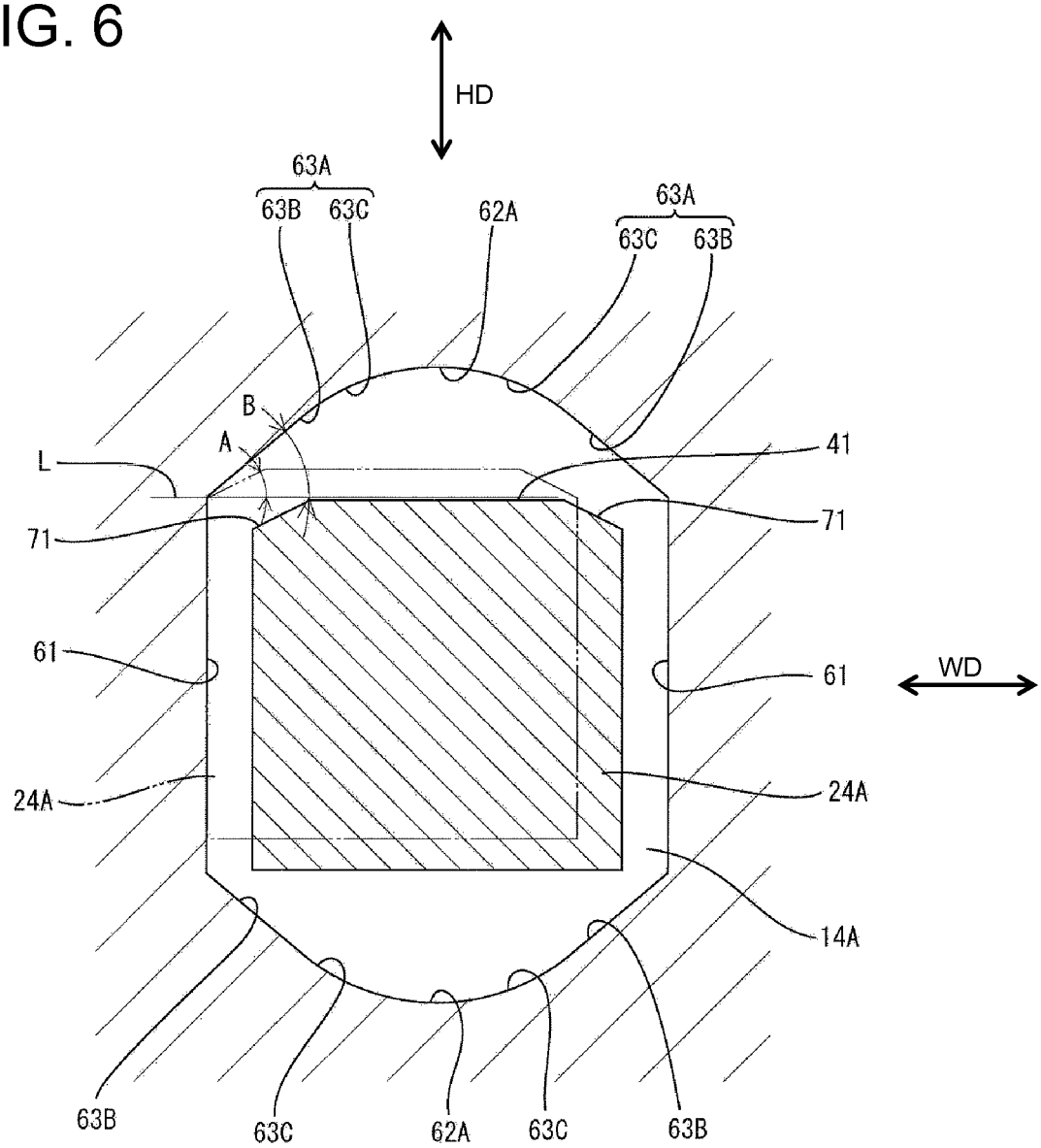
FIG. 6 is an enlarged vertical section showing a state where a touching section is inserted in a press-in hole.
Figure 7:
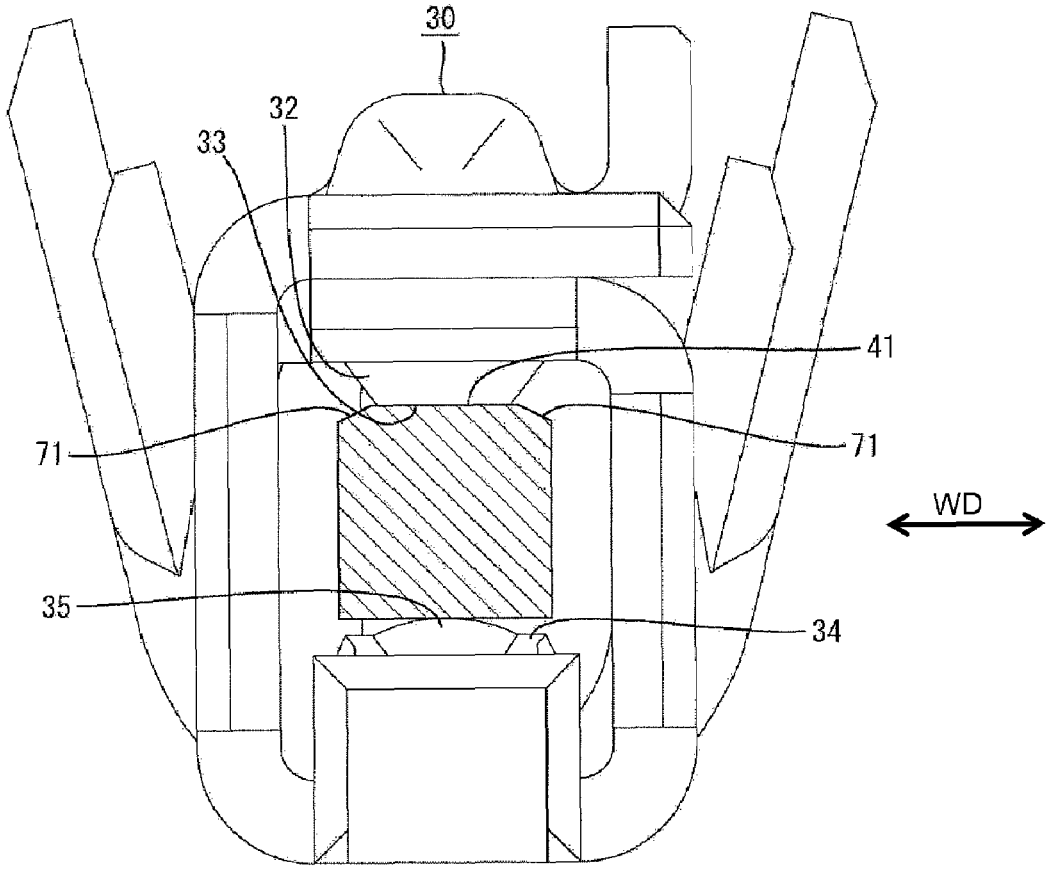
FIG. 7 is an enlarged vertical section showing a state where the touching section is in contact with a mating terminal.

As shown in FIGS. 5 and 6, the narrow section 24A of each terminal fitting 20 has bevels 71 at the opposite widthwise corners of a touching section 41. The bevels 71 are formed by chamfering two corners of the narrow section 24A over substantially the entire length of the narrow section 24A in forward and backward directions FBD including a tapered surface 29, and are lower than the horizontal surface of the touching section 41. As shown in FIG. 7, the horizontal surface of the touching section 41 achieves surface contact with a contact surface 33 of a receiving portion 32 when the narrow section 24A enters a box portion 31 of a mating terminal 30, as in the first embodiment. The bevels 71 are not in contact with the mating terminal 30 including the receiving portion 32.

The inner surface of the press-in hole 14A of a housing 10 includes left and right side surfaces 61, upper and lower apices 62A corresponding to a substantially widthwise middle part 65 of a passage area of the touching section 41, upper and lower pairs of ridge surfaces 63A gradually distanced from the passage area as they extend toward the apices 62A. Unlike the first embodiment, a substantially planar surface 63B extends obliquely up from the respective the side surface 61 and an inwardly concave curved section 63C extends up from the planar section 63B to the apex 62A. Each apex 62A is on an arc defined by the curved sections 63C.

As shown in FIG. 6, an angle of inclination B of the planar surface 63B with respect to a reference line L parallel to the touching section 41 is larger than an angle of inclination of the ridge surface 63 in the first embodiment, and is larger than a bevel angle A of the bevel 71 with respect to the reference line L.

Accordingly, a clearance invariably is defined between the bevels 71 and the planar sections 63B of the ridge surfaces 63A when the touching section 41 passes through the press-in hole 14A, unless the narrow section 24A is inclined a large amount about an axis. Thus, the bevels 71 and the ridge surfaces 63A will not abrade against each other. Abrasion of the touching section 41 and the ridge surfaces 63A is unlikely since the touching section 41 is a horizontal surface. As a result damage of the touching section 41 is prevented securely. Accordingly, the bevels 71 at the opposite widthwise corners of the touching section 41 reliably prevent damage to the opposite widthwise sides of the touching section 41. The function of positioning the touching section 41 by forming the straight sections 63B is described in the first embodiment.

The invention is not limited to the above described and illustrated embodiments. For example, the following embodiments are also embraced by the technical scope of the present invention as defined by the claims.

The invention also is applicable in the case where two receiving portions are formed substantially side by side in the width direction in the mating terminal and two touching sections are formed in the terminal fitting. In this case, two apices are formed at positions on the inner surface of the press-in hole corresponding to the two touching sections, ridge surfaces extend towards the respective apices and the cross-sectional shape of the press-in hole corresponding to the two touching sections is double-peaked.

The ridge surfaces may be outwardly convex curves extending towards the apices.

The method for forming the bevels at the opposite widthwise end corners of the touching section is not limited to the one in the second embodiment, and the present invention is widely applicable, including the case of the first embodiment.

It is sufficient to provide the apex and the ridge lines at the position of the inner surface of the press-in hole corresponding to the passage area of the touching section, and it is not necessary to provide the pair of upper and lower apices and the upper and lower pairs of ridge surfaces.

The terminal fittings may be press-fit into holes in a printed circuit board.

The terminal fittings may be substantially straight rather than L-shaped.

The terminal fittings may have a constant width without being divided into the narrow sections and the wide sections.

Each through hole of the housing may have no guiding hole and no recessed hole and may be entirely a press-in hole.

The invention also is applicable to a connector where a part of the inner surface of the press-in hole corresponding to a passage area of the touching section is shaped to be distanced from the passage area towards several apices or vertices. This is a case where the straight sections 63B on each side of the press-in hole do not directly intersect each other, but similar to FIG. 6 have an intermediate section (similar to the bent section 63C) between them with several apices e.g. by being somewhat undulated.

What is claimed is:

1. A connector, comprising:

at least one terminal fitting including a front section and a rear section rearward of the front section, opposite first and second surfaces extending along the front and rear sections and defining a substantially uniform thickness, the rear section defining a selected width, at least one touching section on at least one of the first and second surfaces to be held in contact with a mating terminal; and a housing formed with at least one press-in hole for receiving a portion of the terminal fitting, the press-in hole having opposed first and second substantially parallel side surfaces spaced apart by a distance substantially corresponding to the selected width of the rear section of the terminal fitting, first and second ridge surfaces extending obliquely from the respective first and second side surfaces toward one another and an apex extending between the ridge surfaces and substantially opposed to a passage area of the touching section of the terminal fitting so that the apex is distanced from the passage area of the touching section;

wherein at least one bevel is formed at least at one of opposite widthwise corners of the touching section of the terminal fitting; and wherein a bevel angle of the bevel is smaller than an angle of inclination of the ridge surfaces of the inner surface of the press-in hole of the housing to a reference line parallel to the touching section.

2. The connector of claim 1, wherein the terminal fitting is configured to be held pressingly in the housing after the touching section passes through the press-in hole.

3. The connector of claim 1, wherein the touching section is at a substantially widthwise middle part of the terminal fitting and the apex, is at a substantially widthwise middle part of the press-in hole.

4. The connector of claim 1, wherein the press-in hole(14; 14A) has opposite side surfaces (61) the ridge surfaces (63) being substantially planar and extending from the respective side surfaces (61) to the apex (62),the apex(62)defining a line where the ridge surfaces (61) intersect.

5. The connector of claim 1, wherein the side surfaces of the press-in hole extend from the ridge surfaces a distance greater than a distance from the side surfaces to the apex.

6. The connector of claim 5, wherein an angle between the ridge surfaces at the opposite sides of the apex is larger than about 120°.

7. The connector of claim 5, wherein angles between the side surfaces and the ridge surfaces are smaller than about 120°.

8. The connector of claim 1 wherein:

the housing is formed with a through hole penetrating in a press-in direction of the terminal fitting, and the press-in hole is formed only in a part of the through hole in the press-in direction.

9. The connector of claim 1, wherein the terminal fitting includes a wide section behind the touching section in the press-in direction, the wide section being wider than the touching section and being dimensioned to be pressed and fixed by the inner surface of the press-in hole.

10. A connector, comprising:

at least one terminal fitting having opposite front and rear ends, a narrow section substantially adjacent the front end and a wide section rearward of the narrow section, opposite first and second surfaces extending along the narrow and wide sections and defining a substantially uniform thickness, at least one touching section formed at a widthwise intermediate position of at least the first surface on the narrow section for contacting a mating terminal, the touching section being plated with a conductive material; and a housing formed with opposite front and rear ends, a substantially tubular receptacle at the front end and a back wall at a rear part of the receptacle, at least one through hole formed through the back wall, the through hole including a press-in portion having opposite substantially parallel side surfaces spaced apart sufficiently for holding the wide section of the terminal fitting, ridge surfaces extending obliquely from the respective side surfaces and at least one apex joining portions of the ridge surfaces spaced from the respective side surfaces, the apex being spaced from and substantially opposed to the touching section as the narrow section of the terminal fitting is inserted through the through hole, whereby the apex substantially prevents abrasion between the plated touching section and the housing;

wherein bevels are formed at opposite widthwise corners of the touching section of the terminal fitting; and wherein a bevel angle of the bevels is smaller than an angle of inclination of the ridge surfaces of the inner surface of the press-in hole of the housing to a reference line parallel to the touching section.

11. The connector of claim 10, wherein the apex is substantially symmetrically disposed relative to the side surfaces.

12. The connector of claim 10, wherein the ridge surfaces are substantially planar and the apex is substantially linear.

13. The connector of claim 11, wherein an angle between the ridge surfaces at the opposite sides of the apex is larger than about 120°.

14. The connector of claim 11, wherein at least portions of the ridge surfaces spaced from the side surfaces define inwardly concave surfaces and the apex defines and inwardly curved concave surface.

15. The connector of claim 10, wherein angles between the side surfaces and the ridge surfaces are smaller than about 120°.

16. The connector of claim 10, wherein the terminal fitting is bent at a position between the back wall of the housing and the rear end of the terminal fitting, the bend of the terminal fitting being about an axis aligned substantially parallel to a line extending substantially perpendicularly between the side surfaces of the through hole.

* * * * *